US005197393A

United States Patent [19]

Yeakle

[11] Patent Number: 5,197,393

[45] Date of Patent: Mar. 30, 1993

[54] LIFT AND TILT POST TABLE

[75] Inventor: William H. Yeakle, Angola, Ind.

[73] Assignee: Vestil Manufacturing Company, Angola, Ind.

[21] Appl. No.: 703,602

[22] Filed: May 21, 1991

[51] Int. Cl.[5] ..... A47F 5/12

[52] U.S. Cl. ..... 108/10; 108/7; 108/147

[58] Field of Search ..... 108/10, 7, 9, 6, 1, 108/144, 147; 248/397, 371, 407

[56] References Cited

U.S. PATENT DOCUMENTS

| | | | |
|---|---|---|---|
| 280,776 | 7/1883 | Altheide | 108/9 X |
| 702,749 | 6/1902 | Smith | 108/10 |
| 1,437,670 | 12/1922 | Mazoch | 108/144 |
| 1,685,445 | 9/1928 | Bash | 248/161 X |
| 3,915,102 | 10/1975 | Barron | 108/144 |
| 4,360,182 | 11/1982 | Titus | 248/371 |

FOREIGN PATENT DOCUMENTS

| | | | |
|---|---|---|---|
| 680539 | 1/1965 | Italy | 108/1 |
| 619392 | 3/1949 | United Kingdom | 108/7 |

*Primary Examiner*—Jose V. Chen

*Attorney, Agent, or Firm*—George Pappas

[57] ABSTRACT

A table wherein the elevation and tilt of the table top are adjustable under power assist by a single hydraulic cylinder. The table includes a substantially horizontal base and a substantially horizontal frame disposed above the base, with a plurality of adjustable-length support posts disposed between the base and the frame, one end of each support post being affixed to the base and the other end of each support post being affixed to the frame. Post lock pins on each of the plurality of support posts selectively lock each support post at a selected length. A table top disposed above and supported by the frame is attached to the frame by a hinge. A table lock selectively locks the table top to the frame to prevent tilting of the table about the hinge. A hydraulic lift cylinder is dipsosed between and connected to the table top and the base for lifting the table top relative to the base. The left cylinder can raise the table top and the frame together when the table lock is locked and each of the post lock pins is unlocked, and the lift cylinder can tilt the table top about the hinge without raising the frame when the table lock is unlocked and each of the post locks is locked.

20 Claims, 3 Drawing Sheets

LIFT AND TILT POST TABLE

BACKGROUND OF THE INVENTION

The present invention relates generally to adjustable tables, and more particularly to an adjustable table for which both the elevation and tilt of the table top are adjustable.

There is a general need for a table whose working surface is adjustable both with regard to its elevation above the floor and with regard to its angle of inclination. One particular application for such a table involves supporting a parts picking box near a worker at an assembly line workstation. The task of the worker at such a workstation often involves picking a part from a box of parts and assembling the selected part to a unit on the assembly line. This task is repeated often during the work day, often with a duplication of the same motion. It is advantageous to worker productivity to have the picking box situated at the proper elevation and tilted at the correct angle so that time and motion are not wasted in picking a part from the part box. In addition, it is advantageous toward reducing cumulative trauma disorders caused by repetitive motions to have the picking box disposed at a convenient and comfortable elevation and angle.

The present invention presents a table that can be readily adjusted both as to height and tilt with power assist, while maintaining a simple design that is economical to manufacture.

SUMMARY OF THE INVENTION

The present invention, in accordance with one aspect thereof, provides a table including a base and a frame disposed above the base. A plurality of adjustable-length support posts are disposed between the base and the frame, with one end of each support post being affixed to the base and the other end of each support post being affixed to the frame. Post lock means on each of the plurality of support posts are provided for selectively locking each support post at a selected length. A table top is disposed above and supported by the frame. Hinge means for hingedly attaching the table top to the frame are provided. Table lock means are provided for selectively locking the table top to the frame to prevent tilting of the table about the hinge means. Lift means are disposed between and connected to the table top and the base for lifting the table top relative to the base. The arrangement is such that the lift means can raise the table top and the frame together when the table lock means is locked and each of the post locks is unlocked, and the lift means can tilt the table top about the hinge means without raising the frame when the table lock means is unlocked and each of the post locks is locked.

It is an object of the present invention to provide a power assisted lift table wherein the height and tilt of the table top can be adjusted.

It is a further object of the present invention to provide an adjustable-height and adjustable-tilt table wherein adjustment of both the height and the tilt is assisted by a single power assist device.

Further objects and advantages of the present invention will be apparent from the following descriptions of a preferred embodiment, and from the claims appended hereto.

DESCRIPTION OF THE PREFERRED EMBODIMENT

Figure 1:
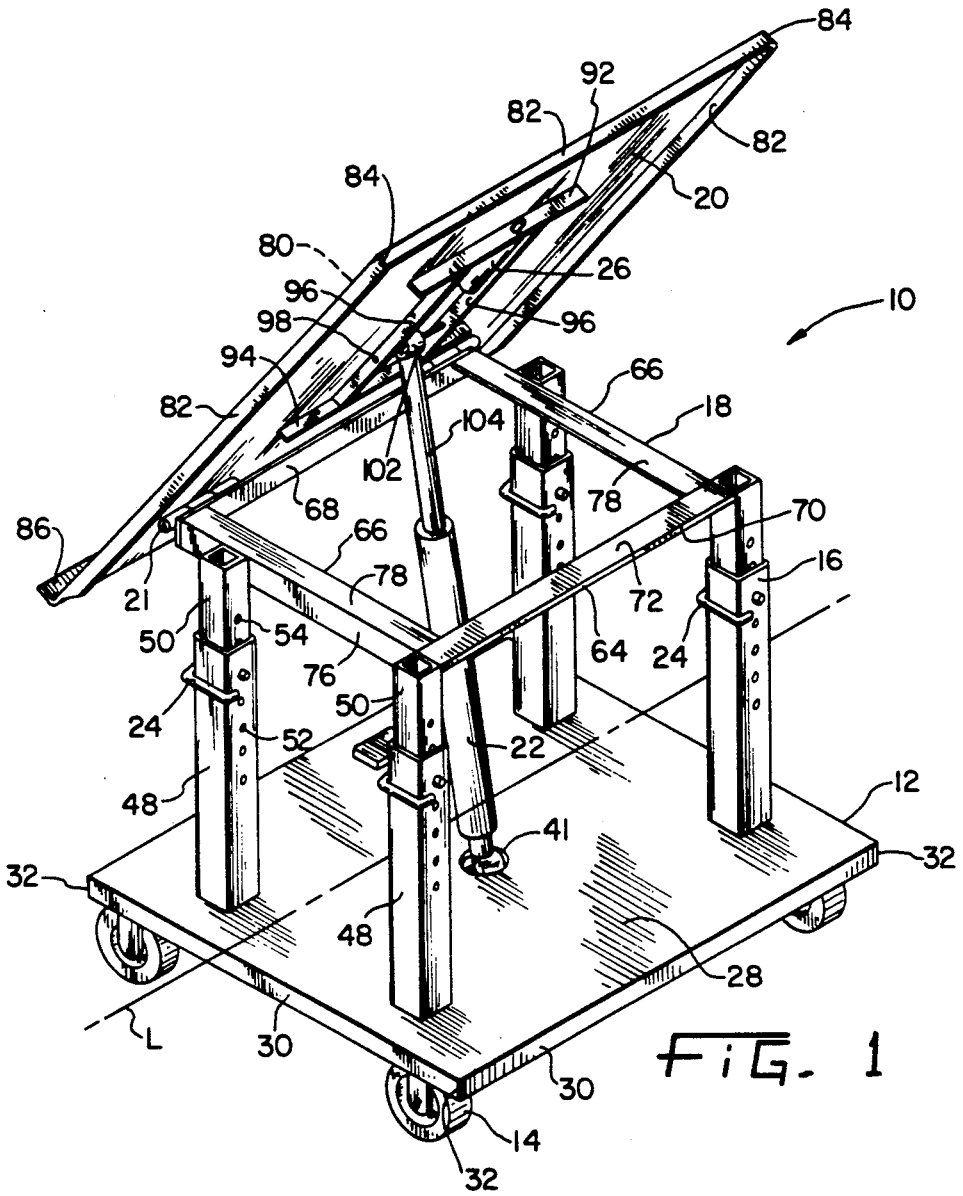
FIG. 1 is a perspective view of a table in accordance with the present invention, shown with the table top tilted upwardly.
Figure 2:
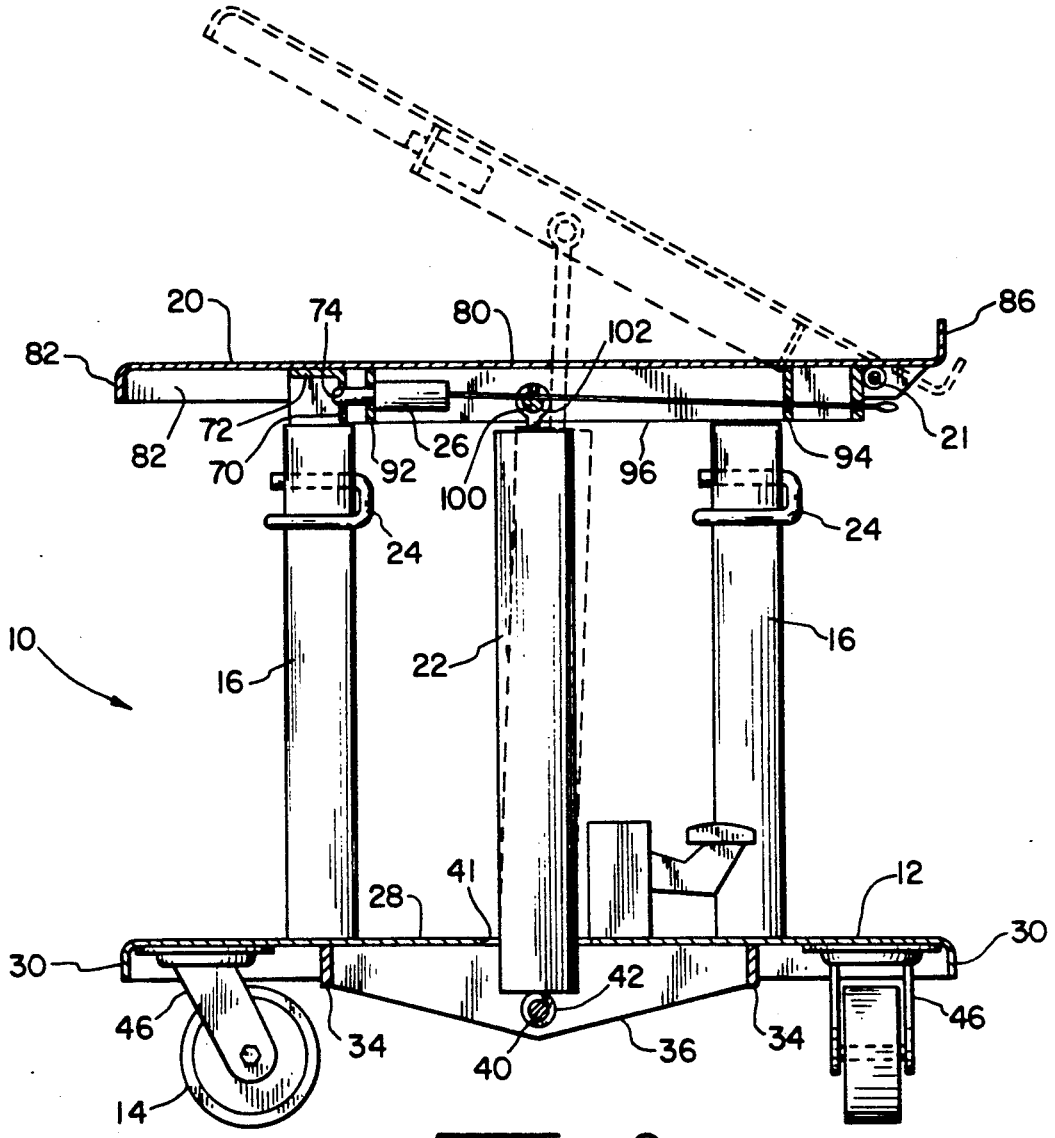
FIG. 2 is a cross-sectional view of the table of FIG. 1, taken along a vertical plane perpendicular to longitudinal axis L of FIG. 1, and substantially bisecting the table. The tilted orientation of the table top is illustrated with dashed lines.
Figure 3:
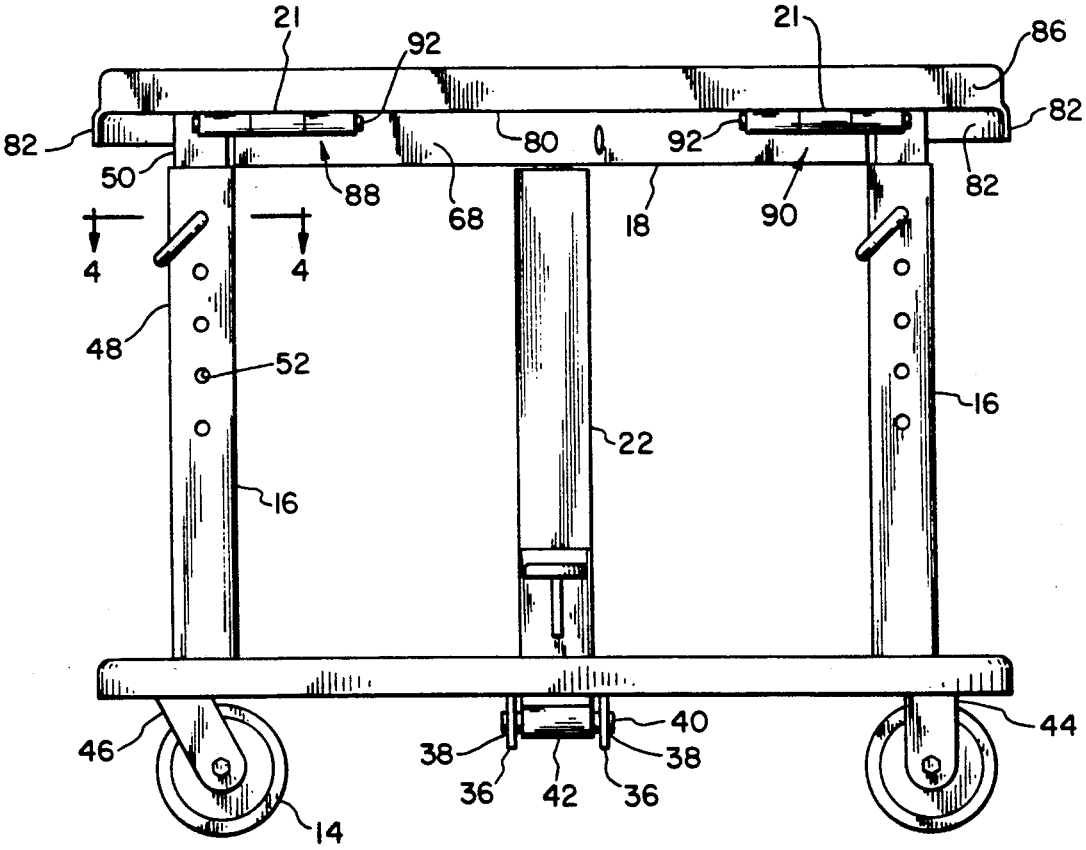
FIG. 3 is a rear elevational view of the table of FIG. 1, showing in particular the hinges attaching the table top to the frame.

Referring to FIGS. 1-3, there is illustrated a preferred embodiment of a table 10 constructed in accordance with the present invention. Some of the major components of table 10 include a base 12 supported by four wheels 14, four adjustable-length support posts 16 which extend upwardly from base 12, a frame 18 connected to the top ends of support posts 16, and a table top 20 hinged to frame 18 by hinge 21. A hydraulic or pneumatic cylinder 22 is connected at its bottom end to base 12 and at its top end to table top 20. Post locks 24 on each post 16 permit selective locking of each adjustable-length post 16 at a selected length. Table lock 26 permits selective locking of table top 20 to frame 18 for selectively preventing table top 20 from tilting about hinge 21.

Base 12 is comprised of a substantially horizontally disposed rectangular steel plate 28 having four peripheral downturned edges forming vertical perimeter skirt walls 30 welded together at corners 32. The longer sides of rectangular base 12 lie parallel to longitudinal axis L. Welded to the underside of plate 28 are a pair of spaced elongate vertical reinforcement plates 34 lying parallel to longitudinal axis L. A pair of lower cylinder brackets 36 are spaced relative to one another and are disposed between reinforcement plates 34 perpendicular thereto. Cylinder brackets 36 comprise vertical plates and are welded to the underside of base plate 28 and to reinforcement plates 34 which they abut. Each cylinder bracket 36 includes a hole 38 therethrough at about the lateral midpoint thereof, the holes 38 being aligned parallel to longitudinal axis L for receipt of lower cylinder pivot pin 40 therethrough. Pivot pin 40 passes through pivot sleeve 42 at the bottom end of cylinder 22 such that cylinder 22 is pivotally attached to brackets 36 and, thus, to base 12. An opening 41 in base plate 28 is situated directly above pivot pin 40 and between cylinder brackets 36. Opening 41 is of sufficient width in the direction parallel to longitudinal axis L to receive cylinder 22 therethrough without interference, and is elongated sufficiently in the direction perpendicular to longitudinal axis L to permit pivotal motion of cylinder 22 about pivot pin 40 without interference.

Wheels 14 are supported by brackets of two types, the first bracket type 44 having a horizontal axle that is fixed in orientation, and the second bracket type 46 having a horizontal axle that is swiveled about a vertical axis. Fixed axle brackets 44 are welded to the underside of base plate 28 proximate the corners 32 along one of the short sides of rectangular base 12, with the axles oriented perpendicular to the longitudinal axis L. Swiveled axle brackets 46 are welded to the underside of base plate 28 proximate the corners 32 along the short side of rectangular base 12 opposite the short side along which fixed axle brackets 44 are disposed. The axles of brackets 46 are supported for swivelling action about a vertical axis. Each bracket 44 and 46 extends downwardly from base 12 such that wheels 14 are disposed therebelow.

Extending upwardly from the top surface of base plate 28 of base 12 are four adjustable-length support posts 16 spaced from one another such that one support post 16 is disposed proximate each corner 32 of base 12. The support posts are so arranged that each post defines an outer corner of a horizontal polygon, with the horizontal polygon preferably being a rectangle whose long and short sides are parallel to and correspond to the long and short sides of base 12. Each post 16 is comprised of hollow tubes of rectangular or square cross section, with each post 16 further including a first outer section 48 welded at the lower end thereof to base plate 28, and a second inner section 50 of smaller cross-sectional dimension telescopically received within the first section 48 in longitudinal sliding relationship. The outer cross-sectional dimensions of the inner section 50 are chosen to be slightly less than the inner cross-sectional dimensions of the outer section 48 to permit free sliding therebetween, while providing lateral stability of support posts 16 in their extended dispositions. A plurality of holes 52 are evenly spaced vertically along first section 48, with each hole 52 passing through opposite walls of the tubing of first section 48 in an alignment perpendicular to longitudinal axis L. A corresponding plurality of holes 54 are evenly spaced vertically along second section 50 at the same pitch as holes 52, and are similarly aligned. Holes 52 and 54 permit the length of support posts 16 to be selectively adjusted in discrete intervals by sliding second inner section 50 relative to first outer section 48 until holes 52 and 54 are aligned with one another at a selected length for support posts 16, and then inserting a post lock pin 24 through one set of aligned holes 52 and 54 in each post 16 to lock each inner section 50 against sliding relative to the respective outer section 48.

Figure 4:
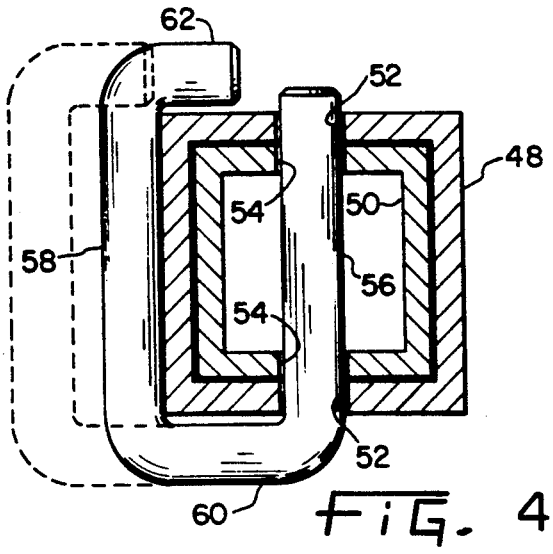
FIG. 4 is a cross-sectional view of one of the legs of the table of FIG. 1, taken along section line 4—4 of FIG. 3 and viewed in the direction of the arrows.

With particular reference to FIG. 4, post lock pin 24 is substantially U-shaped, with a first straight leg 56 for insertion into holes 52 and 54 being of sufficient length to pass through aligned holes 52 on both walls of outer section 48. A second leg 58 spaced from leg 56 by bail 60 is generally parallel to first leg 56, but includes a hook end 62 extending toward first leg 56. Bail 60 is of sufficient length that first leg 56 can be inserted into holes 52 without hook end 62 interfering with outer section 48 so long as bail 60 is held perpendicular to post 16. Once post lock pin 24 is fully inserted through holes 52 in first outer section 48, bail 60 can be dropped, whereupon second leg 58 rests under force of gravity against the outer wall of first outer section 48, with hook end 62 wrapped around the corner thereof to prevent post lock pin 24 from accidentally working free of holes 52.

Referring again to FIGS. 1–3, frame 18 is affixed to the upper end of inner support posts 50 and is disposed in a substantially horizontal rectangular arrangement. Frame 18 comprises a lock brace 64, a pair of side braces 66, and a hinge plate 68. Lock brace 64 is an angle-iron of L-shaped cross-section extending horizontally between the upper ends of two adjacent second inner sections 50 and welded thereto, and is disposed parallel to longitudinal axis L. Lock brace 64 includes a vertical leg 70 disposed flush with the inward sides of the respective post sections 50 to which it is attached, and a horizontal leg 72 flush with the upper ends of the post sections 50 to which it is attached. Horizontal leg 72 extends outwardly from vertical leg 70 and terminates flush with the outward sides of the post sections 50 to which it is attached. A lock hole 74 is located in vertical leg 70 at substantially the lateral midpoint thereof for engagement with table lock 26, as described below. Side braces 66 are angle-irons of L-shaped cross-section substantially similar to lock brace 64 that are welded to and extend horizontally from lock brace 64 perpendicular thereto and are also welded to the upper ends of the two second inner sections 50 opposite the inner sections 50 to which lock brace 64 is attached. Side braces 66 are disposed perpendicular to longitudinal axis L. Each side brace 66 includes a vertical leg 76, the outward surface of which is disposed flush with the inward sides of the respective post sections 50 to which it is attached. Each side brace 66 also includes a horizontal leg 78 flush with the upper ends of the post sections 50 to which it is attached. Horizontal leg 78 extends inwardly from vertical leg 76. One end of each side brace 66 abuts and is welded to the vertical leg 70 of lock brace 64. The other end of each side brace 66 extends horizontally beyond the other pair of inner post sections 50. Hinge plate 68 is a flat vertical plate welded to the ends of side braces 66 opposite lock brace 64. Hinge plate 68 terminates in the horizontal direction flush with the vertical legs 76 of side braces 66 and terminates upwardly flush with horizontal legs 78 of side braces 66.

Table top 20 is comprised of a substantially horizontally disposed rectangular steel plate 80 having three adjacent ones of its four peripheral edges turned down to form vertical perimeter skirt walls 82 welded together at corners 84. The two shorter peripheral edges perpendicular to longitudinal axis L are both turned down to form skirt walls 82, along with one of the long peripheral edges parallel to longitudinal axis L, in particular the long peripheral edge disposed adjacent and parallel to lock brace 64 of frame 18. The other long peripheral edge, in particular the one disposed adjacent and parallel to hinge plate 68, is turned up to form a vertical lip 86. Table top 20 lies atop frame 18 and is supported thereby.

Hinge 21 interconnects table top 20 and hinge plate 68 of frame 18 such that table top 20 is capable of being raised upwardly relative to frame 18 by being tilted about the hinge axis of hinge 21, which hinge axis is parallel to longitudinal axis L. In particular, hinge 21 is comprised of a pair of hinge members 88 and 90 spaced from each other and axially aligned. Each hinge member 88 is itself comprised of three axially aligned tubular hinge sections arranged end-to-end, with a hinge pin 92 received therethrough. Each end of hinge pin 92 is appropriately upset to prevent it from sliding out of hinge member 88. Hinge member 88 is situated on the outward side of hinge plate 68 of frame 18 and on the underside of plate 80 of table top 20 at the intersection thereof. Adjacent hinge sections of hinge member 88 are welded to opposite ones of the hinge plate 68 and plate 80. For example, the outer (in the hinge axis direction) hinge sections can be welded to the underside of plate 80, while the middle hinge section can be welded to the hinge plate. Hinge member 90 is constructed essentially similar to hinge member 88.

Welded to the underside of plate 80 of table top 20 are a pair of spaced elongate vertical reinforcement plates 92 and 94 lying parallel to longitudinal axis L. The lengths and placement of reinforcement plates 92 and 94 are such that they are received inwardly of frame 18 between the members thereof, with plate 92 lying next adjacent and parallel to the vertical leg 70 of lock brace 64 when table top 20 is disposed in its horizontal orientation atop frame 18. A pair of upper cylinder brackets 96 are spaced relative to one another and are disposed between reinforcement plates 92 and 94 perpendicular thereto. Cylinder brackets 96 comprise vertical plates and are welded to the underside of plate 80 and to reinforcement plates 92 and 94 which they abut. Each cylinder bracket 96 includes a hole 98 therethrough at about the lateral midpoint thereof, the holes 98 being aligned parallel to longitudinal axis L for receipt of upper cylinder pivot pin 100 therethrough. Pivot pin 100 passes through pivot sleeve 102 at the top end of cylinder 22 such that cylinder 22 is pivotally attached to brackets 96 and, thus, to table top 20.

Cylinder 22 is a hydraulic or pneumatic cylinder of the type comprising a tubular casing in which is received either a double acting or single acting piston actuated by fluid or gas supplied externally under pressure. In general, the piston rod 104 which is attached to the piston inside cylinder 22 and to pivot sleeve 102 outside cylinder 22 is caused to exert force upwardly against table top 20 while cylinder 22 simultaneously exerts force downwardly against base 12, whenever cylinder 22 is pressurized for expansion. The source of hydraulic pressure can either be a motor or manually operated hydraulic pump disposed on base 12. If pneumatic operation is used, an air compressor and appropriate valving serve as the pressure source.

Figure 5:
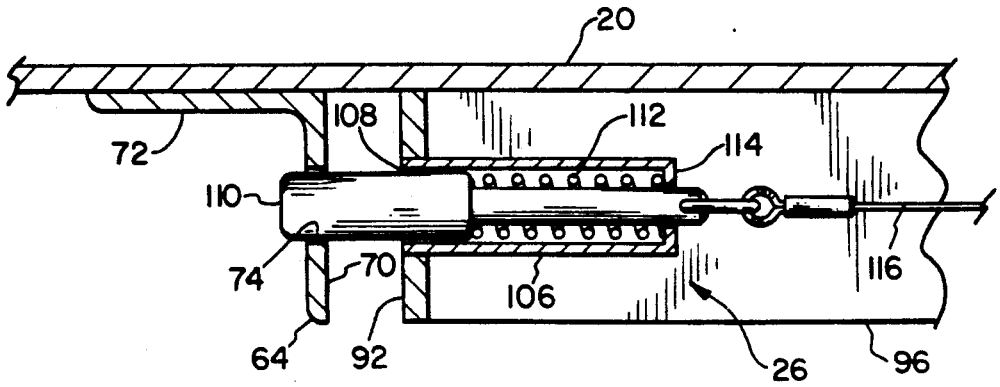
FIG. 5 is an enlarged cross-sectional view of a portion of FIG. 2, particularly showing the table lock mechanism.

Referring to FIG. 5, table lock 26 includes a tubular member 106 disposed between upper cylinder brackets 96 and affixed to reinforcing plate 92 of table top 20. An open end of tubular member 106 is welded to reinforcing plate 92 so as to communicate with a hole 108 through plate 92 and aligned with lock hole 74 of lock brace 64. A lock pin 110 is received within tubular member 106 and is biased outwardly through hole 108 by a compression coil spring 112 disposed within tubular member 106 between lock pin 110 and closed end 114 of tubular member 106. When table top 20 is disposed in its horizontal orientation atop frame 18, lock pin 110 can be urged by spring 112 to extend outwardly through hole 108 of reinforcement plate 92 and extend into lock hole 74 of lock brace 64, thereby locking table top 20 to frame 18 to prevent tilting of table top 20 about hinge 21. Lock pin 110 can be retracted from lock hole 74 against spring 112 by manually pulling retraction cord 116 which is attached to a shank portion of lock pin 110 extending through coil spring 112 and an aperture in closed end 114 of tubular member 106.

Table 10 has two modes of operation: one in which cylinder 22 operates to raise the elevation of table top 20 and frame 18 relative to base 12 while table top 20 remains in its horizontal orientation, and one in which table top 20 is tilted about hinge 21 while the elevation of frame 18 relative to base 12 remains fixed. The first mode of operation is instituted by placing table top 20 in its horizontal orientation and locking it to frame 18 with table lock 26. Next, post lock pins 24 are removed from support posts 16 so that the length of posts 16 can be adjusted. Thereafter, cylinder 22 is activated so as to expand and exert a force upwardly on table top 20 and downwardly on base 12, simultaneously. The expansion of cylinder 22 causes table top 20 to raise relative to base 12. Frame 18, to which table top 20 is affixed by hinge 21 and table lock 26, is caused to be raised along with table top 20, and second inner sections 50 of support posts 16 are raised therewith. As sections 50 telescope up from first outer sections 48, the sliding telescopic relationship between sections 50 and 48 of posts 16 causes table top 20 to be guided and stabilized and to remain level. Once table top 20 has been raised to the desired selected elevation, with holes 54 and 52 of support posts 16 aligned, post lock pins 24 are re-inserted into holes 54 and 52 to lock sections 50 and 48 of each post 16 together. Thereafter, table top 20 is supported by posts 16 at the selected elevation, and cylinder 22 can be relieved of pressure, if desired. The second mode of operation is instituted by locking sections 50 and 48 of posts 16 together to fix posts 16 at a selected length, if that is not already the case. Next, table top 20 is unlocked from frame 18 by retracting lock pin 110 from lock hole 74 via retraction cord 116. Thereafter, cylinder 22 is activated so as to expand and exert a force upwardly on table top 20 and downwardly on base 12, simultaneously. The expansion of cylinder 22 causes table top 20 to tilt upwardly about hinge 21, with the portion of table top 20 opposite hinge 21 being raised relative to frame 18. Post lock pins 24 hold frame 18 down against the lifting force exerted thereon by table top 20 via hinge 21. Once table top 20 has reached the desired degree of inclination, further expansion of cylinder 22 is halted. The tilt angle of table top 20 is maintained or altered by appropriate adjustment of the state of expansion of cylinder 22, while keeping post locks 24 in place.

While the present invention has been particularly described in terms of a preferred embodiment, it should be understood that no limitation of the scope of the invention is intended thereby, and that the scope of the invention includes variations, uses or adaptations of the invention following the general principles thereof, including such departures from the present disclosure as come within known or customary practice in the art to which this invention pertains, limited only by the claims appended hereto.

What is claimed is:

1. A table comprising:

a base;

a frame disposed above said base;

a plurality of adjustable-length support posts disposed between said base and said frame, one end of each support post being affixed to said base and the other end of each support post being affixed to said frame;

post lock means on at least one of said plurality of support posts for selectively locking said support post at a selected length;

a table top disposed above and supported by said frame;

hinge means for hingedly attaching said table top to said frame;

table lock means for selectively locking said table top to said frame to prevent tilting of said table about said hinge means;

lift means disposed between and connected directly to said table top and said base for lifting said table top relative to said base;

said lift means raising said table top and said frame together when said table lock means is locked and said post lock means is unlocked, and said lift means tilting said table top about said hinge means without raising said frame when said table lock means is unlocked and said post lock means is locked.

2. The table of claim 1, in which said plurality of support posts are spaced horizontally relative to one another such that each post defines a corner of a horizontal polygon.

3. The table of claim 2, in which said plurality of support posts includes four posts arranged in a quadrangle.

4. The table of claim 3, in which said base is substantially flat and rectangular and substantially horizontally disposed.

5. The table of claim 4, in which said frame rigidly interconnects said sections of said adjustable-length support posts affixed thereto.

6. The table of claim 5, in which said frame includes four elongate members affixed to one another and arranged in a plane substantially as a quadrangle.

7. The table of claim 6, in which each of said plurality of adjustable-length support posts includes a first section and a second section disposed in vertical sliding relationship relative to one another, one of said first and second sections being affixed to said base and the other of said first and second sections being affixed to said frame.

8. The table of claim 7, in which the second section of each support post is telescopically received within the first section of said support post.

9. The table of claim 8, in which said post lock means includes a plurality of equally spaced holes through each of the first and second sections of at least one of said plurality of adjustable-length support posts, and further including a pin removably receivable through aligned holes of said first and second sections.

10. The table of claim 9, in which said lift means is disposed within the polygon defined by said plurality of support posts.

11. The table of claim 10, in which said lift means includes an extensible cylinder having a cylinder case and a piston rod, one of said cylinder case and piston rod being pivotally affixed to said base and the other of said cylinder case and a piston rod being pivotally affixed to said table top.

12. The table of claim 11, in which said extensible cylinder is extensible upwardly through the quadrangle formed by said frame.

13. The table of claim 12, in which said hinge means includes a hinge having first and second parts pivotable relative to one another, the first part affixed to said table top and the second part affixed to one elongate member of said frame forming one side of the quadrangle.

14. The table of claim 13, in which said table lock means includes a movable lock member supported by one of said table top and said frame, said movable lock member being engagable with the other of said table top and said frame to prevent displacement of said table top in a direction perpendicular to the plane of said frame.

15. The table of claim 14, in which the lock member of said table lock is engagable with that elongate member of said frame forming that side of the quadrangle which is opposite said elongate member of said frame to which said hinge is affixed.

16. The table of claim 1, in which each of said plurality of adjustable-length support posts includes a first section and a second section disposed in vertical sliding relationship relative to one another, one of said first and second sections being affixed to said base and the other of said first and second sections being affixed to said frame.

17. The table of claim 16, in which the second section of each support post is telescopically received within the first section of said support post.

18. The table of claim 17, in which said lift means includes an extensible cylinder having a cylinder case and a piston rod, one of said cylinder case and piston rod being pivotally affixed to said base and the other of said cylinder case and a piston rod being pivotally affixed to said table top.

19. The table of claim 18, in which said post lock means includes a plurality of equally spaced holes through each of the first and second sections of at least one of said plurality of adjustable-length support posts, and further including a pin removably receivable through aligned holes of said first and second sections.

20. The table of claim 19, in which said table lock means includes a movable lock member supported by one of said table top and said frame, said movable lock member being engagable with the other of said table top and said frame to prevent displacement of said table top in a direction perpendicular to the plane of said frame.

* * * * *

UNITED STATES PATENT AND TRADEMARK OFFICE

CERTIFICATE OF CORRECTION

PATENT NO. : 5,197,393

DATED : March 30, 1993

INVENTOR(S) : William H. Yeakle

It is certified that error appears in the above-identified patent and that said Letters Patent is hereby corrected as shown below:

Title Page:
In the Abstract, line 17, change "left" to --lift--.

Signed and Sealed this

Thirtieth Day of November, 1993

Bruce Lehman

*Attest:*

BRUCE LEHMAN

*Attesting Officer*

*Commissioner of Patents and Trademarks*